United States Patent [19]

Yoshida

[11] Patent Number: 4,982,590

[45] Date of Patent: Jan. 8, 1991

[54] ROLL-FORMING APPARATUS FOR WIRE STOCK

[76] Inventor: Keiichiro Yoshida, 497, Shimonagayoshi, Mobara, Chiba, Japan

[21] Appl. No.: 221,917

[22] Filed: Jul. 20, 1988

[30] Foreign Application Priority Data

Jul. 20, 1987 [JP] Japan ..... 62-180488
Jul. 23, 1987 [JP] Japan ..... 62-184388

[51] Int. Cl.[5] ..... B21B 13/00

[52] U.S. Cl. ..... 72/235; 72/237; 72/244; 72/248

[58] Field of Search ..... 72/235, 237, 244, 248

[56] References Cited

U.S. PATENT DOCUMENTS 780,644 1/1905 Edwards ..... 72/235
1,697,012 1/1929 Kronenberg ..... 72/248
4,763,505 8/1988 Klute et al. ..... 72/238
4,768,366 9/1988 Sendzimir ..... 72/237

*Primary Examiner*—Lowell A. Larson
*Assistant Examiner*—T. C. Schoeffler
*Attorney, Agent, or Firm*—Wenderoth, Lind & Ponack

[57] ABSTRACT

A roll-forming apparatus is specifically designed to handle metal wires or other wire stock that is not for or is difficult for use in a drawing process, so that it can provide a reduced-diameter wire in a roll-forming process. The apparatus comprises a framed structure having four sides within which a pair of roll-forming rollers are arranged in parallel, one roller being powered by a driving power source, and the other roller being interchangeable. For a typical application, a plurality of such apparatuses may be arranged in series such that each unit is oriented at a right angle with regard to its adjacent unit.

17 Claims, 6 Drawing Sheets

ROLL-FORMING APPARATUS FOR WIRE STOCK

BACKGROUND OF THE INVENTION

1. Field of the Invention

The present invention relates generally to a metal-wire working process, and more particulary to a roll-forming apparatus that reduces a wire stock into a smaller-diameter shape through the roll-forming process.

2. Description of the Prior Art

The conventional working process for a metal rod such as a metal wire stock, through which it is reduced to a smaller diameter or cross section, usually consists of roll-forming the wire stock into a diameter of 6 mm (for some special applications, 3 mm), followed by drawing such reduced-diameter wire into a further smaller diameter by plastic working. It is known that this plastic-working process includes two different methods, i.e., forming by force of pressure and elongation by drawing. Which of the two is used depends upon the type and/or property of the stock to be worked. For the pastic-working of a stock which has a relatively easy-to-break or fragile material property, the forming by force of pressure is primarily employed, and for a stock of material that is easy to elongate, the drawing process is primarily employed. For the drawing process, it may involve using an apertured die or using a roller die. It is known that the drawing process can occur more easily and more effectively by using the roller die than by using the apertured die (as disclosed in Japanese patent application as published under No. 58 (1983)-17686, for example).

As described, the forming by force of pressure and the drawing process have their own features and merits, and the drawing process involving the use of the roller die in particular provides a higher working efficiency.

For the drawing process, however, a preparatory step is required during which a wire stock to be drawn must pass through a series of roller dies prior to the actual drawing process, which requires the corresponding amount of time. Also, the drawing process has a reduction breakage limit. Because of this limit, the reduction (rate of decreasing cross section) through a single pass must usually be limited to 30% to 40%.

The roller-dies drawing process is not adequate for fragile material stock, which is difficult to work by using the roller dies and should rather be drawn by force of pressure. However, the prior art roller dies such as those mentioned earlier have a construction that does not allow the roller dies to be coupled with the driving power source, and cannot be used for drawing by force of pressure. Furthermore, it has the reduction limit as described above, and requires more passes until a final desired diameter (or cross section) can be obtained.

Although the conventional drawing processes as mentioned above may be capable of roll-forming a thin wire stock (such as from 2 mm to 0.5 mm, for example), they cannot be used for a wire stock of a smaller diameter (such as from 0.5 mm to 0.15 mm).

The roll-forming process requires that 1 as the diameter (or cross section) of a particular wire stock to be roll-formed becomes smaller, the rollers must have smaller diameters. When the smaller-diameter rollers are used, the roll-forming process must occur at a slower rate for a given number of rotations of the motor for powering those rollers.

In roll-forming those very thin wire stocks, it may be suggested that the input (driving) rollers have the same diameter (which ensures that all input rollers run with the same efficiency when the motor rotates at a fixed speed), and the follower (driven) rollers be varied in diameter for each different-diameter wire stock to be roll-formed. In this case, however, it would be necessary to provide individual roller shafts of different diameters for the corresponding different-diameter follower rollers. Whenever the follower rollers of a given diameter are changed, the roller shafts must also be changed. This problem remains yet to be solved.

In most cases where a particular wire stock is to be roll-formed into a wire of reduced diameter or cross section, it is usual to develop a reduction plan as shown in the table 1, and this reduction planning may be provided by assuming a plane of square cross section and by calculating the involved parameter values so that the final desired shape of a given wire stock can be progressively approximated to the polygonal shape such as an octagon, beginning with that square cross section (FIG. 7). An example of those parameter values thus obtained is given in Table 1. It has already been described that for the thin wire stock to be roll-formed, the smaller-diameter rollers can provide the smaller-diameter wire.

TABLE 1

| PASS NO. | W mm | H mm | Am/m2 | b | Φsize |
|---|---|---|---|---|---|
| 1 | 2.394 | 0.898 | 2.67 | 1.693 | 1.844 |
| 2 | 2.221 | 0.833 | 2.323 | 1.571 | 1.7198 |
| 3 | 2.072 | 0.777 | 2.021 | 1.465 | 1.6042 |
| 4 | 1.932 | 0.724 | 1.758 | 1.366 | 1.496 |
| 5 | 1.802 | 0.675 | 1.529 | 1.274 | 1.395 |
| 6 | 1.681 | 0.630 | 1.330 | 1.188 | 1.301 |
| 7 | 1.567 | 0.587 | 1.157 | 1.108 | 1.213 |
| 8 | 1.462 | 0.548 | 1.007 | 1.034 | 1.132 |
| 9 | 1.364 | 0.511 | 0.876 | 0.964 | 1.056 |
| 10 | 1.272 | 0.477 | 0.762 | 0.899 | 0.984 |
| 11 | 1.186 | 0.455 | 0.663 | 0.839 | 0.918 |
| 12 | 1.107 | 0.415 | 0.577 | 0.782 | 0.857 |
| 13 | 1.032 | 0.387 | 0.502 | 0.730 | 0.799 |
| 14 | 0.962 | 0.360 | 0.436 | 0.680 | 0.745 |
| 15 | 0.898 | 0.336 | 0.380 | 0.635 | 0.695 |
| 16 | 0.837 | 0.314 | 0.330 | 0.592 | 0.548 |

SUMMARY OF THE INVENTION

In order to obviate the problems of the prior art roll-forming or drawing processes mentioned above, the present invention proposes to provide an improved roll-forming apparatus that is specifically designed to handle a thin wire or rod stock and consists essentially of a frame structure functionally equivalent to a C clamp or squill vice and having four sides secured in position, within which a pair of mating roll-forming roller means for being supplied with pressure force are disposed, and roller shafts are mounted across the corresponding roll-forming roller means perpendicularly to the direction of the applied pressure force.

In its one specific form, the roll-forming apparatus according to the present invention includes a four-sided frame structure for providing the equivalent function of a C clamp or squill vice, a pair of mating roll-forming rollers arranged in parallel to occupy the central position within the frame structure, and a pressure force supply means mounted on the upper side of the frame for supplying its pressure force to the roll-forming rollers. The roll-forming rollers are supported by roller shafts that are mounted across them perpendicularly to the direction of the pressure force adjustably supplied by the pressure force supply means and one of the roller shafts is coupled with its driving shaft.

For the roll-forming apparatus of the form described above, the frame structure has the equivalent function of the C clamp or squill vice having one of the four sides open, for example. The frame structure has mounting holes at the four corners thereof for receiving mounting bolts, respectively, which fasten the frame in its position. The driven roller has a roller journal bearing mounted around the opposite ends of its shaft, and an upper bearing assembly is disposed between the pressure supply means and the driven roller so that part of the driven roller and part of the roller journal bearings can be accommodated inside the upper bearing assembly. The driving shaft for the driver roller may be directly coupled with a drive motor's output shaft, or may be coupled with the drive motor's output shaft through reduction gears.

It will be appreciated that as input power is connected to the driving shaft which in turn is connected to the roller shaft for supporting the driving roll-forming roller, the pair of roll-forming rollers can form a wire stock into a desired diameter or cross section with a small rolling pressure force and with the same efficiency as if the wire stock would be formed through the drawing process.

It will also be appreciated that for roll-forming a very thin wire stock that has a diameter range of 0.5 mm to 0.15 mm, a combination of two different diameter roll-forming rollers may be used. It has been proved that in this way, those roll-forming rollers can provide a wire of the desired diameter or cross-section without affecting their rolling pressure force. This means that the driver roll-forming roller coupled with its driving shaft is of a constant diameter while the driven roll-forming roller to be combined with the driver roller may be varied in diameter. In other words, the same driver roller may be used, and the driven roller may be interchangeable. That is, a variety of driven rollers of different diameters may be provided, from which the appropriate one may be chosen, depending upon the desired diameter or cross section of a particular wire stock to be roll-formed.

For instance, if it is assumed that the driver roll-forming roller has a diameter of 20 mm, and its mating roll-forming roller has a diameter of 12 mm. This combination of rollers of different diameters provides a roll-forming function equivalent to a combination of two rollers of identical diameters D, which can be determined from the following equation:

$$D = \frac{2 \times 12 \times 20}{12 + 20} = 15$$

As it has been demonstrated, the combination of two different-diameter rollers has the capability of roll-forming a wire stock of up to about 0.15 mm diameter.

It may be appreciated from the above description that the present invention allows a large-diameter, driving roller and an interchangeable smaller-diameter roller to be driven by the driver roller to be paired in any combination, depending upon the desired diameter or cross section of a wire stock to be formed. The smaller-diameter roller may have a diameter range for which the lower limit is up to 90% and 35% of that of the large-diameter roller, and for which the upper limit is as much as 35% preferably 40%, preferably 80%, of that for the large diameter roller.

In another specific form, the roll-forming apparatus of the invention includes a first roll-forming roller of a given diameter and a second roll-forming roller of any diameter smaller than the first roll-forming roller, the rollers being arranged in parallel. The first roll-forming roller has its roller shaft coupled with its driving power input, and the second roll-forming roller has its roller shaft journalled by a roller-bearing which engages an upper bearing assembly for applying the pressure force through an intervening jig member. This jig member has one side thereof engaging the roller bearing for the second roll-forming roller, and the other side thereof engaging the upper bearing assembly on the rolling pressure stand side.

The use of the jig member allows for the use of interchangeable driven roll-forming rollers of different diameters, all of which can be provided interchangeably, and mounted with their supporting members remaining unchanged. Thus, those roll-forming rollers may be chosen, depending upon the roll-forming requirements for a very thin wire stock that should be formed to a particular diameter or cross section.

The wire stocks to be roll-formed according to the present invention may be of various types, including thermocouples (temperature sensors), sheathed heater coils or wires, superconductor wires (ceramics), and the like. For each of the wires mentioned specifically, it may consist of an outer metal tube and any suitable filler, such as powdered conductive or superconductor ceramics material, which may be filled through the outer metal tube prior to the roll-forming process. During the actual roll-forming process, the filler material may be roll-formed together with its outer metal tube.

As mentioned above, any suitable filler material may have a powdery form, which may be consolidated into an aggregate solid by applying any required pressure force. This powdery aggregate solid presents a stress or resistance behavior against the applied force of pressure that is absolutely different from the stress presented by a metal when it is subject to the plastic deformation. As such, it will be necessary to provide any pressure force required to cause a fluid motion in the powdery aggregate solid. This may be accomplished by causing the fluid motion as if the powdery solid were broken into pieces while the outer metal tube is being plastic-worked. Generally, the present invention makes it a principle of operation that the roll-forming process proceeds by varying the direction of the rolling pressure by every 90 degrees so that the fluid motion can be produced in the powdery filler solid.

In this way, the solidified powdery filler may be subject to deformation that may shift slightly in a 3-dimensional direction during the roll-forming process, and this shifting may work favorably. The wire stock that has been roll-formed through several passes (or by passing it through a series of roll-forming apparatus) until the desired diameter is obtained can have one or two final passes through apertured dies. The resulting wire will have an evenly distributed and increased filler density.

Usually, the roll-forming process provides a final desired shape by repeating the required number of passes through which the wire stock progressively becomes deformed until the final shape is obtained. This can be accomplished easily and favorably by providing an accurate reduction planning. In this way, there is little or no possibility that the outer metal tube through those planned passes will contain locally and unevenly formed thick portions.

The thin wire stock that has been roll-formed in the above manner can easily be finished by subsequently pass it through apertured dies, particularly as far as the thin wire is concerned. Actually, when it is passed through the apertured dies having polygonal sides, it has been found that no problems are encountered, thereby leading to the favorable die working.

This may be understood from the fact that the outer metal tube can only have its apexes joining adjacent sides plastic-worked due to the apertured dies, rather than having the sides contact the corresponding interior sides due to the apertured dies. The dies drawing plays the positive role of causing a fluid motion in the powdery filler material without consolidating it to an excessively high density solid.

For the above reason, it is not desirable to let the wire stock pass several times through the dies drawing process with too high a reduction rate since problems such as defects may occur.

It will be appreciated that the present invention combines the roll-forming process and the die drawing process, taking advantage of the respective features provided by those two working technologies. Thus, a high-quality metal wire product containing an evenly distributed filler material can be obtained.

It will also be appreciated that for a very thin wire stock that has the diameter range mentioned earlier, the appropriate driven roll-forming roller may be used to meet the diameter requirements for the wire stock, and those interchangeable rollers of different diameters can rotate all at the same speed.

Furthermore, it should be noted that for the embodiment of the present invention where the driven roll-forming rollers provide the respective different diameters and are interchangeable, the jig member may be interposed between the driven roll-forming roller and its pressure-force bearing for permitting any of the driven rollers of different diameters to be combined with the driver roller. In this case, the driven rollers can be interchanged and mounted by using the same mounting support.

BRIEF DESCRIPTION OF THE DRAWINGS

Those and other objects, advantages, and features of the present invention will become more clear from the detailed description of several preferred embodiments that follows by referring to the accompanying drawings, in which.

DETAILED DESCRIPTION OF THE PREFERRED EMBODIMENTS

EXAMPLE 1

Figure 1:
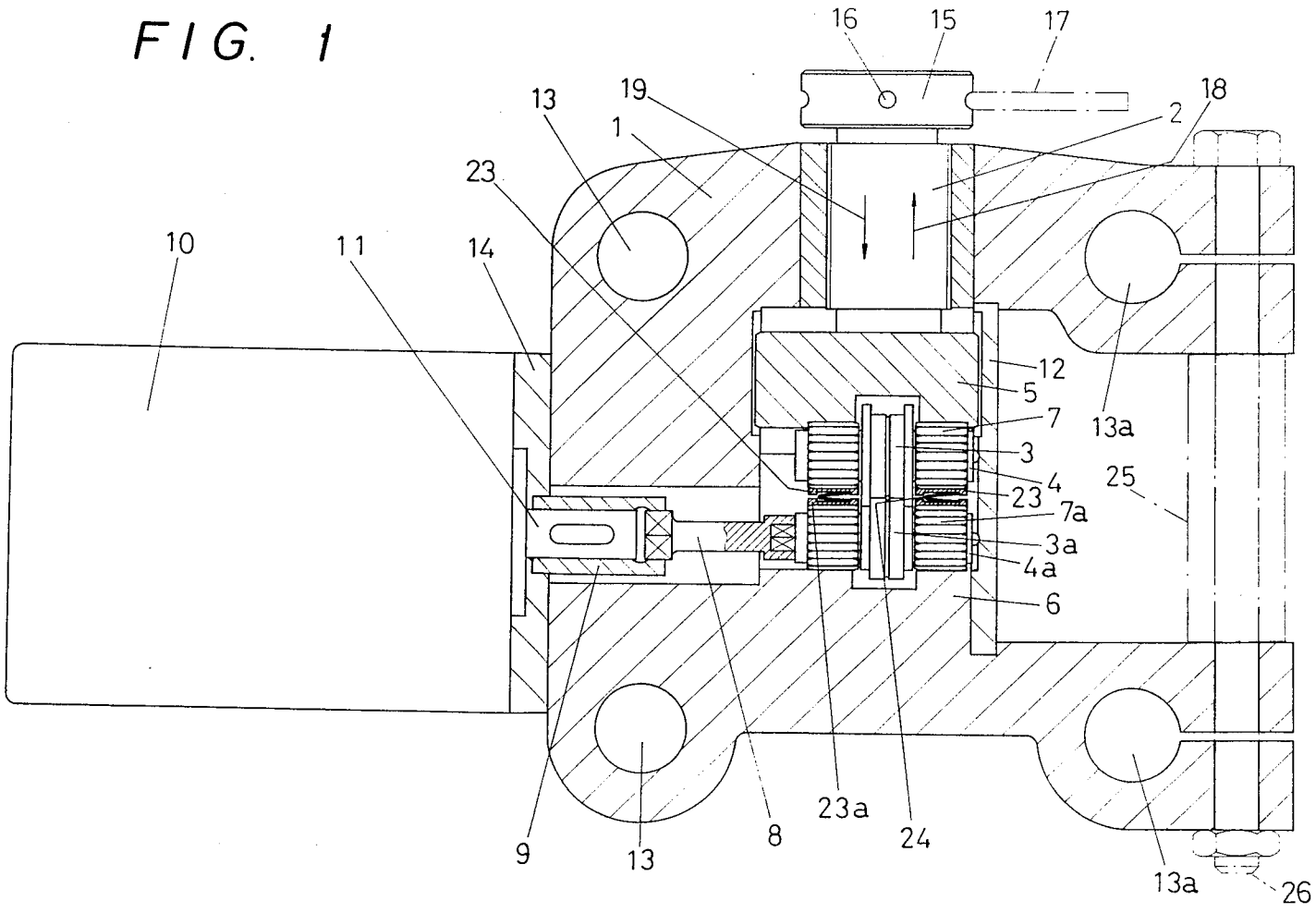
FIG. 1 is a front view of one preferred embodiment of the roll-forming apparatus as shown in a partly enlarged cross section.
Figure 2:
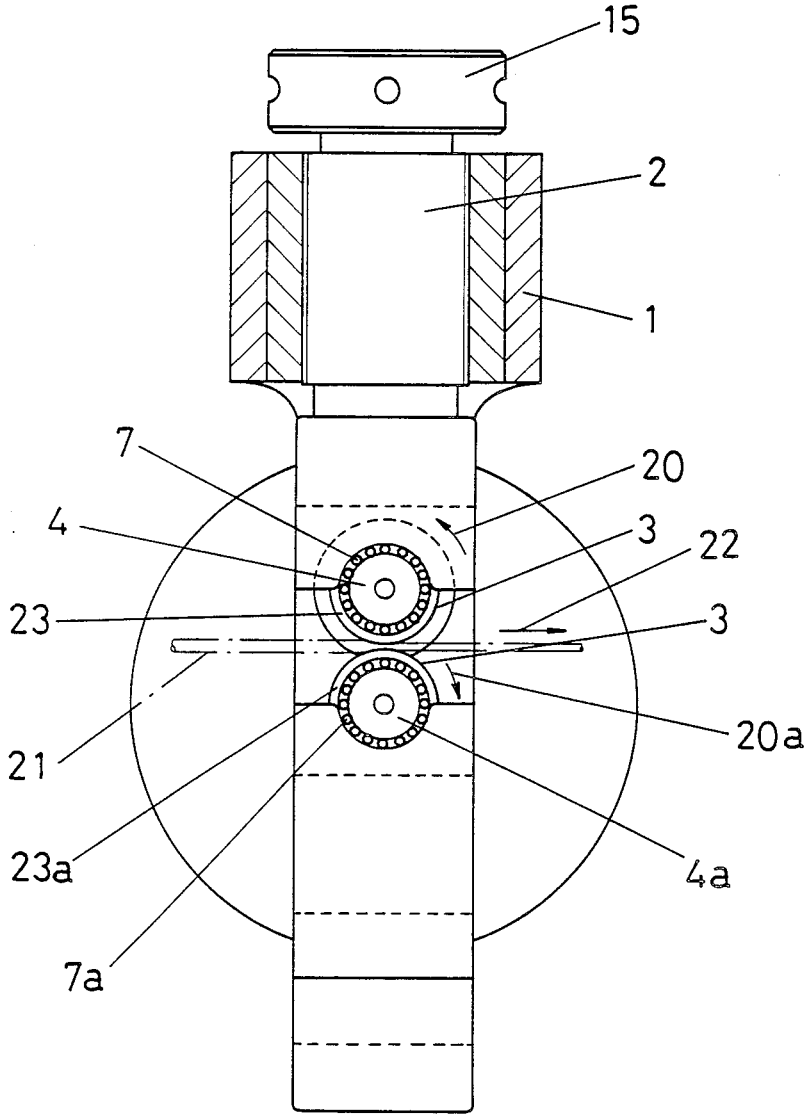
FIG. 2 is a side elevation of the apparatus of FIG. 1 but with the lateral thrust-bearing plate omitted, as shown in a partly enlarged cross section.
Figure 3:
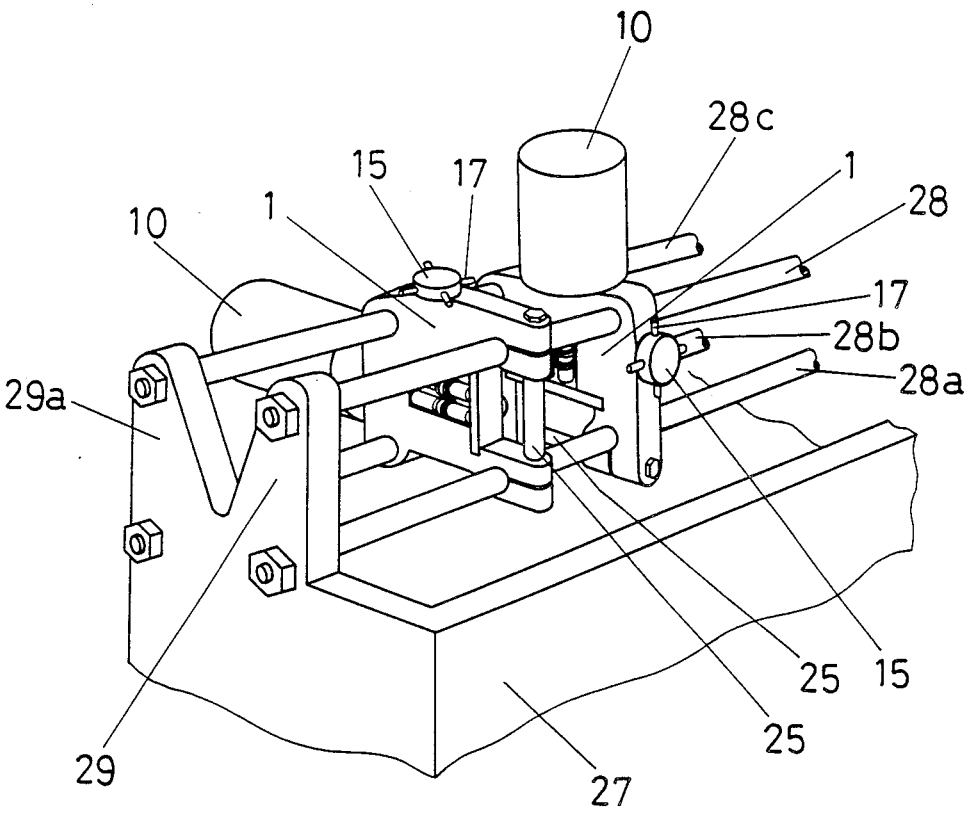
FIG. 3 is a perspective view of the configuration including several units of FIG. 1 (two units shown) arranged in series.

Referring first to FIGS. 1 through 3, the roll-forming apparatus of the invention that represents a first preferred embodiment thereof is described.

In FIG. 1, the apparatus comprises a four-sided frame structure 1, the upper side of which carries a threaded screw 2 at its center extending through it for providing an adjustable pressure force. A pair of roll-forming rollers 3, 3*a* are mounted below the threaded screw 2 such that they are placed perpendicularly with regard to the screw 2. Those roll-forming rollers 3, 3*a* are supported by shafts 4, 4*a* disposed axially therethrough respectively, which are disposed between an upper bearing assembly 5 engaging the bottom end of the threaded screw 2 and a lower bearing assembly 6 on the lower side of the frame structure 1. The shaft 4 for the roll-forming roller 3 has a roller bearing 7 mounted around it, the upper half portion of which is enclosed by the upper bearing assembly 7. Similarly, the shaft 4*a* for the roll-forming roller 3*a* has a roller bearing 7*a* mounted around it, the lower half portion of which is enclosed by the lower bearing assembly 6. Furthermore, the shaft 4*a* for the roll-forming roller 3*a* is connected with its driving shaft 8, which is in turn connected with an output shaft 11 from a motor 10 through a coupling 9. The roller bearing 7 for the roll-forming roller 3 has its lower half portion enclosed by a cover 23, and the roller bearing 7*a* for the roll-forming roller 3*a* has its upper half portion enclosed by a cover 23*a*. Those covers 23 and 23*a* retain their respective positions under the action of a spring 24. On one lateral side of the roll-forming rollers 3 and 3*a*, lateral a thrust sustaining plate 12 is provided. The frame structure 1 is provided with mounting holes 13, 13, 13*a*, 13*a* at the four corners thereof for accommodating bolts for securing the frame structure 1 in position. The motor 10 is mounted to a mounting plate 14 extending from the frame structure 1.

In the embodiment shown and described above, the frame structure 1 has the form of a C clamp or squill vice having its one side open. For example, this side may be provided by a spacer member (sleeve) 25 across open side, which may be mounted by tightening a bolt 26 as indicated by dot-dash lines in FIG. 1. It should be understood that the present invention may include all other possible variations of the frame structure shown in FIG. 1.

The threaded screw 2 has a handle 15 at the top, and the handle 15 has holes 16 at regular intervals around the circumferential side thereof. Each of those holes 16 accepts an operating rod 17. When the operating rod 17 is inserted into any hole and is operated to turn the handle 15 clockwise or counterclockwise, the threaded screw 2 advances or retracts as shown by an arrow 18 or 19, causing the upper bearing assembly 5 also to move in the same direction. Note that the upper bearing assembly 5 is also mounted to the threaded screw 2 to permit rotary motion with the screw 2. With both rotary and translating motion of the upper bearing assembly 5, the roll-forming rollers 3, 3*a* are placed under the pressure force applied by the upper bearing assembly 5. As it may be appreciated, the applied pressure force can be adjusted. When the appropriate pressure force has been established, the drive motor 10 is then started. The driving power output is transmitted through the motor shaft 11 to the roll-forming roller 3a which in this case is the driver. The driver roller 3a rotates in the direction of an arrow 20a in FIG. 2, so that the wire stock 21 between the two rollers 3 and 3a can be delivered out in the direction of an arrow 22 without receiving strong tension force. Thus, the mating or driven roller 3 also rotates in the direction of an arrow 20, roll-forming the wire stock to the desired diameter.

The roll-forming rollers to be used with the present invention are next described. As it will readily be understood from the preceding description, the present invention can accommodate the roll-forming rollers that may have the diameter range of between 25 mm and 15 mm and that may also be grooved or not. Although those rollers may be classed into the very small-diameter rollers, the present invention is specifically designed to accept such rollers with which any wire stock of the corresponding diameter can be handled. For a soft material wire stock that has its tensile strength value of below 40 kg f/mm$^2$, for example, the appropriate roller pair may be used to roll-form it to a diameter of 0.3 mm or equivalent cross section. In this case, the rolling speed may be 120 m/min, possibly up to a maximum 200 m/min. Conversely, for a hard material wire stock having its tensile strength of 80 kg f/mm$^2$ or less, the rolling speed may be 100 m/min.

As described, one of any pair of roll-forming rollers has its shaft coupled with the driving shaft which forces that one roller to be driven. Thus, the wire stock can have the roll-forming process rather than the drawing process, although its effect is equivalent to the drawing process. The desired diameter can be obtained. This is particularly true for a fragile material wire stock, which can be roll-formed to the desired diameter or cross section with high efficiency.

As shown in FIG. 3, a series of the roll-forming apparatuses of the present invention can be provided so that a wire can be deformed continuously without having to feed the wire numerous times through a single roll forming apparatus. The apparatuses should be arranged such that each apparatus is offset 90° from the adjacent apparatus so as to provide proper final deformation of the wire.

EXAMPLE 2

Figure 4:
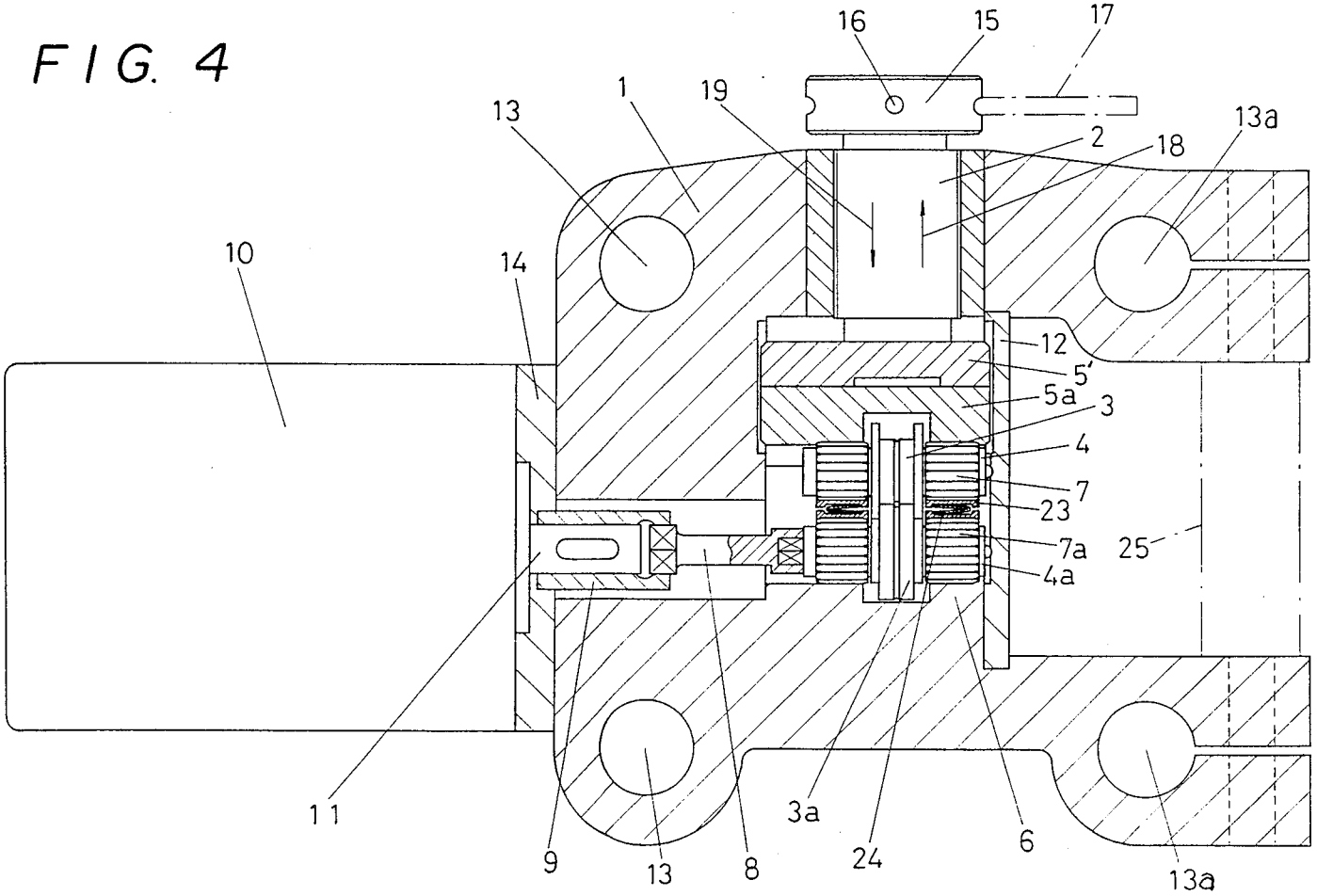
FIG. 4 is a front view of another preferred embodiment of the roll-forming apparatus as shown in a partly enlarged cross section.
Figure 5:
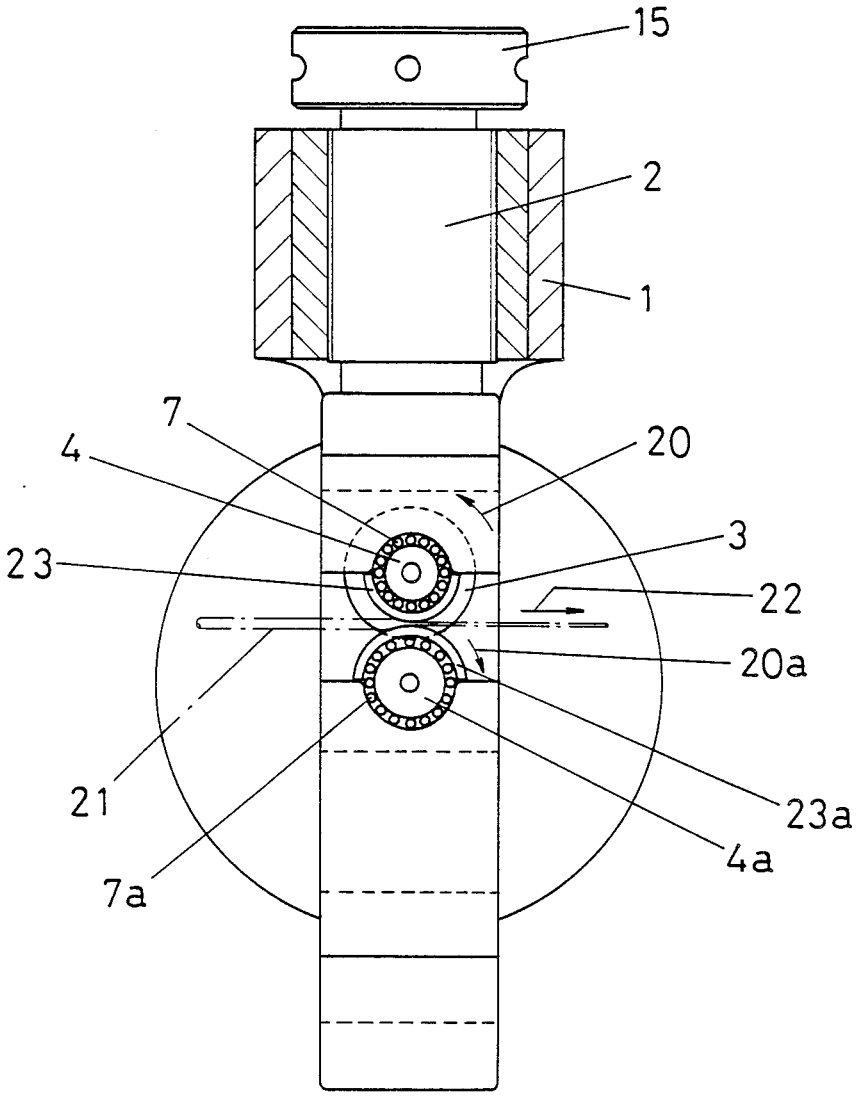
FIG. 5 is a side elevation of the apparatus of FIG. 4 with some parts omitted, as shown on an enlarged scale.
Figure 6:
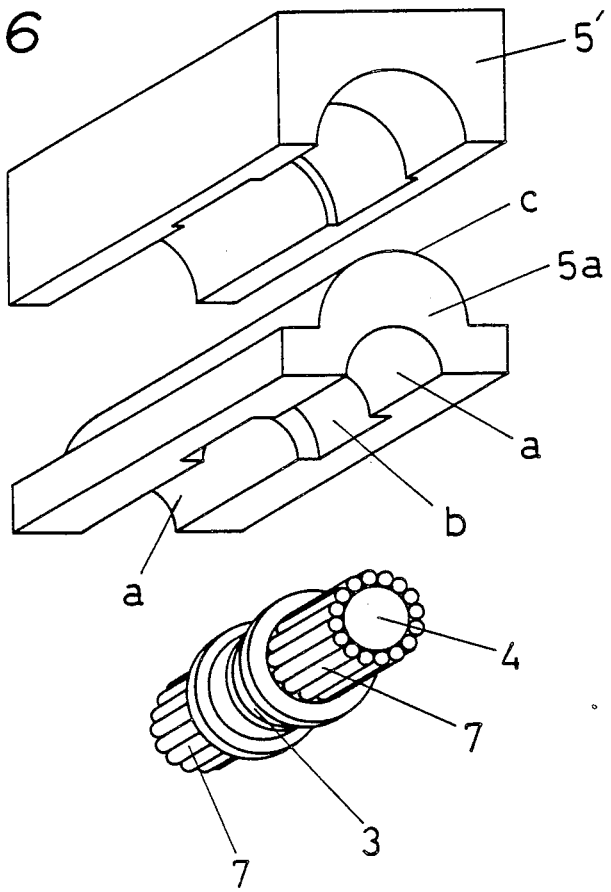
FIG. 6 is a perspective view of the upper portion including the driven roll-forming roller, jig member, and bearing.
Figure 7:
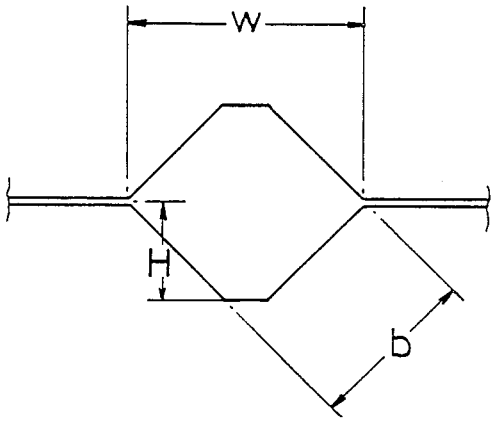
FIG. 7 shows the dimensions to which the symbols given in Table 1 refer.

Referring next to FIGS. 4 through 6, a second preferred embodiment of the present invention is described.

This embodiment includes similar parts or elements as in the preceding embodiment, which are given the same reference numerals as those in FIG. 1 through 3.

In FIG. 4, the apparatus comprises a four-sided frame structure 1, the upper side of which carries a threaded screw 2 at its center extending through it for providing an adjustable pressure force. A pair of first and second roll-forming rollers 3, 3a are mounted below the threaded screw 2 such that they are placed perpendicularly with regard to the screw 2. Those roll-forming rollers 3, 3a are supported by shafts 4, 4a disposed axially therethrough, respectively, which are disposed between an upper bearing assembly 5' engaging the bottom end of the threaded screw 2 and a lower bearing assembly 6 on the lower side of the frame structure 1. As noted from the figures, the upper bearing assembly 5' for this second embodiment is varied from that for the previous embodiment in that it includes a recess extending axially on the underside thereof within which a jig member (or roller holding member) 5a is mounted. The shaft 4 for the first roll-forming roller 3 has a roller bearing 7 mounted around it, the upper half portion of which is enclosed by the jig member 5a. The shaft 4a for the second roll-forming roller 3a has a roller bearing 7a mounted around it, the lower half portion of which is enclosed by the lower bearing assembly 6. On its underside which engages the first roll-forming roller 3, the jig member 5a has lateral recesses a, a on opposite sides and a central recess b between the two recesses, the lateral recesses accepting the corresponding roller bearings therein and the central recess accepting the roll-forming roller 3. On its upper side engaging the upper bearing assembly 5', the jig member has a ridge c which engages the corresponding recess on the bottom of the upper bearing assembly 5'. The roller bearing 7 for the roll-forming roller 3 has its lower half portion enclosed by a cover 23, and the roller bearing 7a for the roll-forming roller 3a has its upper half portion enclosed by a cover 23a. Those covers 23 and 23a retain their respective positions spaced from each other under the action of a spring 24. Similarly to the previous embodiment, lateral thrust sustaining plate 12 is provided on one lateral side of the roll-forming rollers 3 and 3a. The frame structure 1 is also provided with mounting holes 13, 13, 13a, 13a at the four corners thereof for accommodating bolts which fasten the frame structure 1 in position. The motor 10 is mounted to its mounting plate 14 extending from the frame 1.

In the second embodiment shown and described above, the frame structure 1 has the form of a C clamp or squill vice having its one side open. For example, this side may be provided by a spacer member (sleeve) 25 across the open side, which may be mounted by tightening a bolt 26 as indicated by dot-dash lines in FIG. 1. It should be understood that the present invention may include all other possible variations of the frame structure shown in FIG. 4.

The threaded screw 2 has a handle 15 at the top, and the handle 15 has holes 16 at regular intervals around the circumferential side thereof. Each of those holes 16 accepts an operating rod 17. When the operating rod 17 is inserted into any hole and is operated to turn the handle 15 clockwise or counterclockwise, the threaded screw 2 advances or retracts as shown by an arrow 18 or 19, causing the upper bearing assembly 5' also to move in the same direction. Note that the upper bearing assembly 5' is also mounted to the threaded screw 2 to permit rotary motion with the screw 2. With both rotary and translating motion of the upper bearing assembly 5', the roll-forming rollers 3, 3a are placed under the pressure force applied by the upper bearing assembly 5'. As it may be appreciated, the applied pressure force can be supplied adjustably so that the jig member 5a and therefore the roll-forming rollers 3, 3a can be placed under the adjusted pressure. When the appropriate pressure force has been established, the drive motor 10 is then started. The driving power output is transmitted through the motor shaft 11 to the roll-forming roller 3a which in this case is the driver. The driver roller 3a rotates in the direction of an arrow 20a in FIG. 5, so that the wire stock 21 between the two rollers 3 and 3a can be delivered out in the direction of an arrow 22 without receiving strong tension force. Thus, the mating or driven roller 3 also rotates in the direction of an arrow 20, roll-forming the wire stock to the desired diameter.

The roll-forming rollers to be used with the present invention are next described. As it will readily be understood from the preceding description, the present invention can accommodate any combination of the two different roll-forming rollers one of which may have a diameter of 20 mm and the other of which may vary in diameter (the minimum 9 mm). Those rollers may also be grooved or not. Although those rollers may be classed as very small-diameter rollers, the present invention is specifically designed to accept such rollers with which any wire stock of the corresponding diameter can be handled. For a soft material wire stock that has its tensile strength value of below 40 kg f/mm$^2$, for example, the appropriate roller pair may be used to roll-form it to a diameter of 0.15 mm or equivalent cross section. In this case, the rolling speed may be 120 m/min, possibly up to a maximum 200 m/min. Conversely, for a hard material wire stock having its tensile strength of 80 kg f/mm$^2$ or less, the rolling speed may be 100 m/min.

It will be appreciated that the above described embodiment offers many possibilities for roll-forming the various types of wire stock of a very small diameter. In this respect, it is very important.

It will also be appreciated that one of any pair of roll-forming rollers has its shaft coupled with the driving shaft which forces that one roller to be driven. Thus, the wire stock can have the roll-forming process rather than the drawing process, although its effect is equivalent to the drawing process. The desired diameter can be obtained. This is particularly true for a fragile material wire stock, which can be roll-formed to the desired diameter or cross section with high efficiency.

Furthermore, using the two roll-forming rollers of different diameters allows different types of wire stocks to be handled with the roll-forming speed unaltered. The jig member allows the driven rollers to be interchanged on their same mounting supports without having to change them each time.

As different diameters of the second roll-forming rollers may be provided interchangeably and selectively while the first roll-forming roller of a particular diameter may remain to be unchanged, the appropriate roller can be selected to meet the diameter or cross-section requirements for a wire stock to be roll-formed.

Although the present invention has been described with reference to the two specific preferred embodiments and the variations thereof, it should be understood that various further changes and modifications may be made without departing from the scope and spirit of the invention.

What is claimed is:

1. A roll-forming apparatus for roll-forming thin wire stock, comprising:

a frame structure;

roller means, comprising a pair of mating rollers mounted in parallel in a central position within said frame structure for rolling the thin wire stock between said rollers;

pressure force supply means, mounted on an upper portion of said frame structure for imparting an adjustable amount of pressure force to said roller means;

two roller shafts respectively rotatably supporting said rollers for rotation about respective axes, each of said roller shafts being mounted along said respective axes and perpendicularly to the direction of the pressure force adjustably imparted by said pressure force supply means;

drive power shaft means coupled with one of said roller shafts for driving one of said rollers; and wherein said frame structure has one side thereof open, and includes fastening means at the four corners thereof for securing said frame structure in position.

2. A roll-forming apparatus as defined in claim 1, further including an upper bearing having one side thereof engaging said pressure force supply means and the other side thereof engaging the other of said rollers.

3. A roll-forming apparatus as defined in claim 1, including a drive motor having an output shaft coupled with said drive power shaft means.

4. A roll-forming apparatus as defined in claim 1, wherein said pair of rollers comprises a first roller of a particular diameter and a second roller of a diameter smaller than said particular diameter.

5. A roll-forming apparatus as defined in claim 4, wherein said drive power shaft means is coupled to the one of said two shafts which rotatably supports said first roller.

6. A roll-forming apparatus as defined in claim 5, further comprising a roller holding member mounted between said pressure force supply means and said second roller.

7. A roll-forming apparatus as defined in claim 6, further comprising a bearing element mounted between said pressure force supply means and said second roller and in engagement with said pressure force supply means.

8. A roll-forming apparatus as defined in claim 7, wherein said roller holding member has a first side mounted within said bearing element and a second side, opposite said first side, acting against said second roller.

9. A roll-forming apparatus as defined in claim 6, wherein said diameter of said second roller is 40–80% of said particular diameter.

10. A roll-forming apparatus for roll-forming thin wire stock, comprising:

a frame structure;

roller means, comprising first and second mating rollers mounted in parallel in a central position within said frame structure, for rolling the thin wire stock between said rollers, said first roller having a particular diameter and said second roller having a diameter smaller than said particular diameter;

pressure force supply means, mounted on an upper portion of said frame structure, for imparting an adjustable amount of pressure force to said roller means;

two roller shafts respectively rotatably supporting said rollers for rotation about respective axes, each of said roller shafts being mounted along said respective axes and perpendicularly to the direction of the pressure force adjustably imparted by said pressure force supply means;

drive power shaft means, coupled with the one of said two shafts which rotatably supports said first roller, for driving said first roller; and a roller holding member mounted between said pressure force supply means and said second roller.

11. A roll-forming apparatus as defined in claim 10, wherein said diameter of said second roller is 40–80% of said particular diameter.

12. A roll-forming apparatus as defined in claim 10, further comprising a bearing element mounted between said pressure force supply means and said second roller and in engagement with said pressure force supply means.

13. A roll-forming apparatus as defined in claim 12, wherein said roller holding member has a first side mounted within said bearing element and a second side, opposite said first side, acting against said second roller.

14. A roll-forming apparatus as defined in claim 13, further comprising roller bearings connected to opposite axial sides of said second roller; and wherein said roller holding members acts against said roller bearings and has a recess in a central portion of said second side thereof into which said second roller extends.

15. A roll-forming apparatus as defined in claim 13, wherein said bearing element has a first side which engages with said pressure force supply means and a second side, opposite said first side which engages with said roller holding member, said second side of said bearing element having a groove formed therein in parallel with said axes of said rollers, and said first side of said roller holding member having an elongated ridge protruding therefrom, in parallel with said axes of said rollers, and adapted to engage in said groove.

16. A roll-forming apparatus as defined in claim 12, wherein said pressure force supply means includes means positively engaged with said bearing element, for moving said bearing element in opposite directions perpendicular to said axes of said rollers.

17. A roll-forming apparatus as defined in claim 10, wherein said second roller is an idler roller and is caused to rotate by the driven rotation of said first roller.

* * * * *